US006066813A

United States Patent [19]

Bauer et al.

[11] Patent Number: 6,066,813

[45] Date of Patent: May 23, 2000

[54] SWITCH INSERT FOR ROTARY SWITCHES

[75] Inventors: Karl-Heinz Bauer, Bad Neustadt; Thilo Kirchner, Burkardroth, both of Germany

[73] Assignee: Preh-Werke GmbH & Co., Bad Neustadt/Saale, Germany

[21] Appl. No.: 09/188,197

[22] Filed: Nov. 9, 1998

[30] Foreign Application Priority Data

Nov. 29, 1997 [DE] Germany ..... 197 53 079

[51] Int. Cl.[7] ..... H01H 1/44

[52] U.S. Cl. ..... 200/11 B; 200/571

[58] Field of Search ..... 200/11 DA, 565, 200/11 B, 11 C, 11 A, 571

[56] References Cited

U.S. PATENT DOCUMENTS

| | | | |
|---|---|---|---|
| 3,780,238 | 12/1973 | Brant et al. | 200/11 DA |
| 3,924,185 | 12/1975 | Schwarz | 324/115 |
| 4,038,504 | 7/1977 | McAnulty et al. | 200/11 DA |
| 4,166,200 | 8/1979 | Reichen et al. | 200/11 R |
| 4,510,360 | 4/1985 | Golub | 200/11 B X |
| 4,523,175 | 6/1985 | Sakurai | 338/134 |
| 4,723,059 | 2/1988 | Nelson et al. | 200/11 A X |
| 5,290,980 | 3/1994 | Cummings | 200/61.86 |
| 5,315,077 | 5/1994 | Simon et al. | 200/11 R |

FOREIGN PATENT DOCUMENTS

| | | |
|---|---|---|
| PS 489 822 | 1/1930 | Germany . |
| 28 24 584 A1 | 12/1979 | Germany . |

*Primary Examiner*—Renee S. Luebke

*Attorney, Agent, or Firm*—Griffin, Butler, Whisenhunt & Szipl, LLP

[57] ABSTRACT

Most prior-art switch inserts for rotary switches of a type including wiped segments and a switch wiper have a tall construction, and are unsuitable for carrying high current loads. In a switch insert of this invention, wiped segments (5) are arranged inside a plastic plate (8) so that they can be contacted from another side by a further switch wiper (9) having contacts (10) arranged in a mirror image of contacts (11) of a first switch wiper (7), with the further switch wiper (9) having positioning lugs (12) that extend through control recesses (13) of the first switch wiper (7) to accept a leaf spring (15) in a locking slot (14) thereof on the other side. The leaf spring supports itself by resiliently bracing on a surface of the first switch wiper (7) facing away from the contacts (11), and thereby loads the contacts (10, 11) of both switch wipers (7, 9) against the wiped segments (5). Generally switch inserts structured according to this invention provide an extremely flat construction. The doubled contact makes a higher current capacity possible.

4 Claims, 2 Drawing Sheets

SWITCH INSERT FOR ROTARY SWITCHES

BACKGROUND OF THE INVENTION

This invention relates to a switch inset, or insert (which could also be referred to as a mountable switching mechanism), for rotary switches, especially for use as control elements for adjusting heating, air conditioning, and/or ventilation equipment in motor vehicles, of a type having a contact plate with wiped contact segments and plug terminal leads for current conduction and connection and a first switch wiper that can be moved by a rotary switch, whereby the wiped contact segments are arranged in a plastic plate so that they are contacted by a second switch wiper on the other side, with second switch wiper contacts thereof being arranged in a mirror image to first wiper contacts of the first switch wiper.

German patent document (DE 28 24 584 A1) discloses such a switch insert that comprises a contact plate having wiped contact segments and plug terminal leads for current conduction and connection and a switch wiper that can be moved, or adjusted, by a rotary switch manipulator, or knob. Generally, this manner of construction results in a relatively great structural height, which does not allow this rotary switch to be installed for vehicle knobs, for example.

Furthermore, this switch is not suited for modern needs, i.e., higher current loads that can occur when air conditioner motors, window defrosters, etc. are turned on or off.

German patent document (DE-PS 489 822) discloses a rotary switch, in which a fixed contact is between two insulating disks, with contact being made by spring loaded wiper contacts that pass through the insulating disks from both sides. When the switch is manipulated, one of the insulating disks is turned as well, which is for extinguishing any switch fire that may result from a turning off. This structure is not suited for an intended use on a bearing pin.

Therefore, it is an object of this invention to provide a switch insert for a generic rotary switch which permits a flat construction and a high current capacity.

SUMMARY OF THE INVENTION

According to principles of the invention a second switch wiper has positioning, or guiding, lugs that extend through positioning, or guiding, recesses of a first switch wiper and that define locking slots for accepting a leaf spring which resiliently braces itself with a spring bias on an opposite surface of the first switch wiper facing away from first wiper contacts, and in this way loads, or presses, the wiper contacts of both switch wipers against wiped contact segments.

BRIEF DESCRIPTION OF THE DRAWING

The invention is described and explained in more detail below using an embodiment shown in the drawings. The described and drawn features can be used individually or in preferred combinations in other embodiments of the invention. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
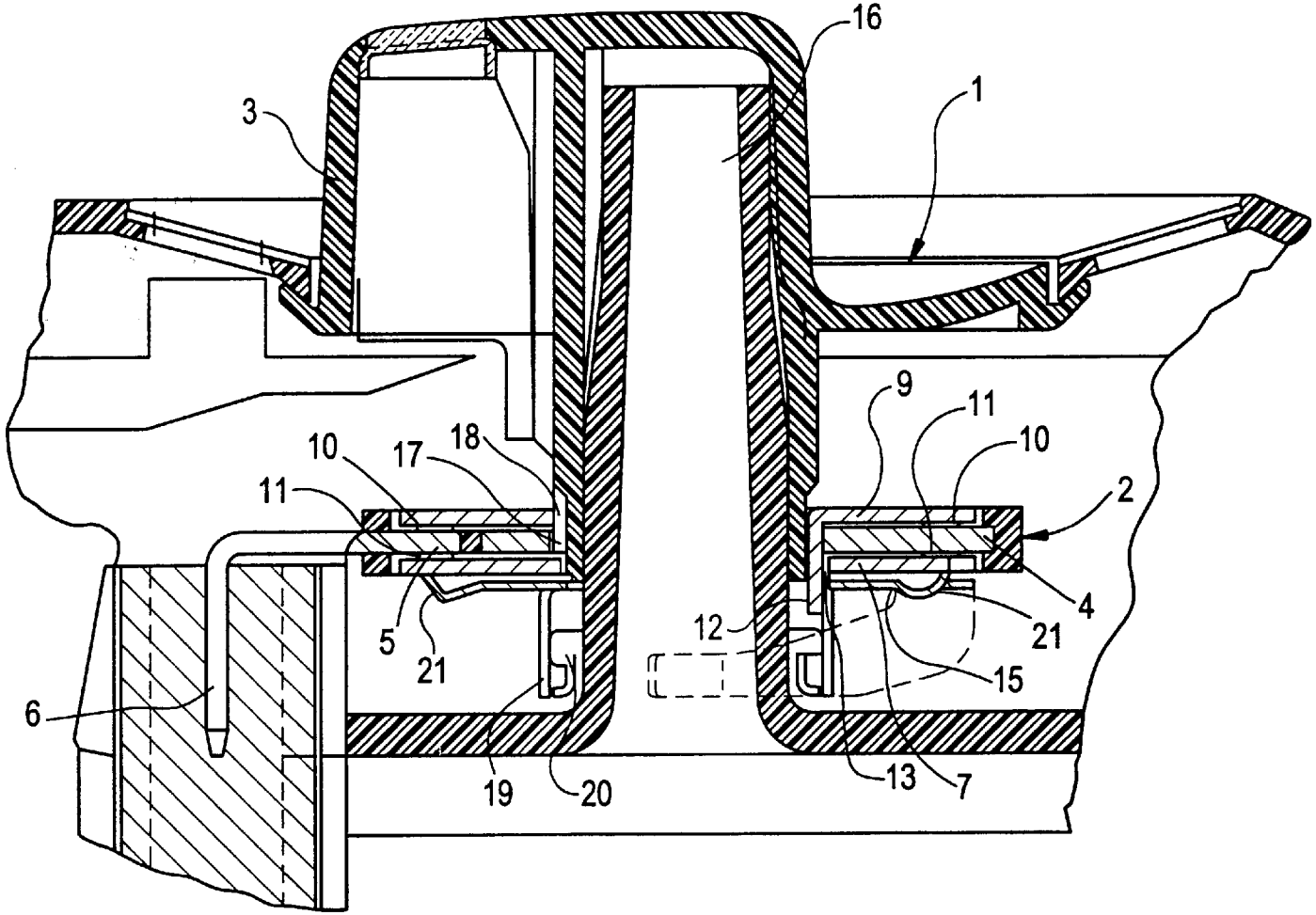
FIG. 1 is a sectional view through a rotary switch with a switch insert of this invention.

FIG. 1 shows a section through a control element 1 for adjusting heating, air conditioning, and/or ventilation equipment in motor vehicles, in which an arrangement of a switch insert 2 and a rotary switch knob, or manipulator, 3 can be seen.

The switch insert 2 comprises a contact plate 4 having wiped contact segments 5 and plug terminal leads 6 for current conduction and interconnection, and a first switch wiper 7 that can be moved by the rotary switch knob 3.

The wiped contact segments 5 are arranged in a plastic plate 8 to also be exposed on a top side (as seen in FIG. 1) so that they can also be contacted from the top side by a second switch wiper 9, second wiper contacts 10 of which are arranged as a mirror image of contacts 11 of the first switch wiper 7, with the second switch wiper 9 having positioning, or guiding, lugs 12 that extend through positioning, or guiding, recesses 13 of the first switch wiper 7 and accept a leaf spring 15 in locking slots 14; which leaf spring, in turn, supports itself by spring bracing on (that is, pushing against with a spring force) a surface of the first switch wiper 7 facing away from the first wiper contacts 11, and in this way loads the first and second wiper contacts 11, 10 of the first and second switch wipers 7, 9 against the wiped contact segments 5.

The switch insert 2 is arranged on a bearing pin 16 that simultaneously bears the rotary switch knob 3, which, with a key lug 17, engages in a control recess 18 of the switch insert 2 and moves the first and second switch wipers 7, 9 with it. The leaf spring 15 has two resilient leaf-spring snapping arms 19 that cooperate with indexing snapping steps 20 of the bearing pin 16 and effect a stopping, or indexing, of the first and second wiper contacts 11, 10 of the first and second switch wipers 7, 9 relative to the wiped contact segments 5.

Figure 2:
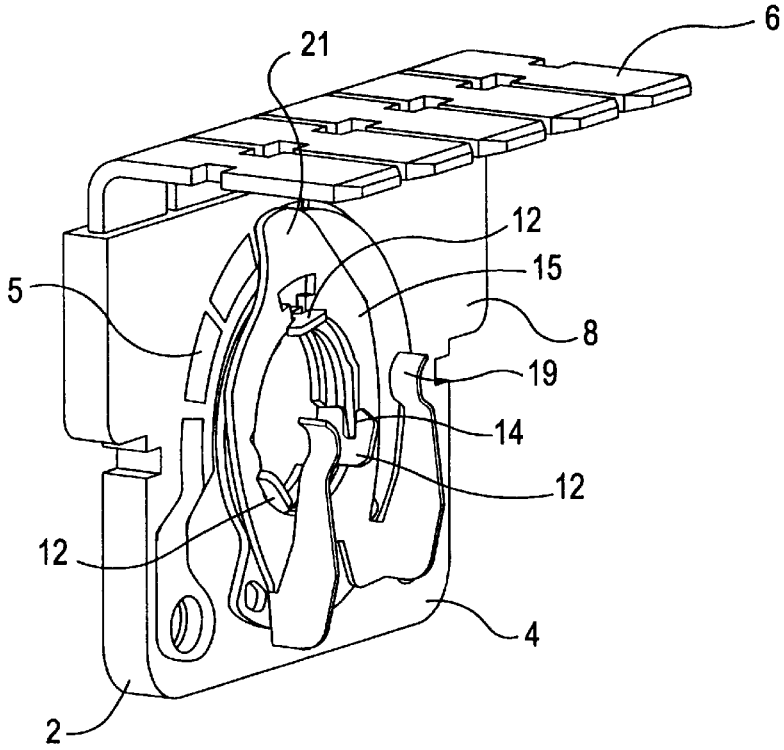
FIG. 2 is a perspective view of the switch insert as an individual item.

FIG. 2 shows the switch insert 2 as an individual item with the contact plate 4 being structured as a plastic plate 8 in which the wiped contact segments 5 are embedded, electrically isolated from each other. The wiped contact segments 5 are connected with the plug terminal leads 6.

Figure 3:
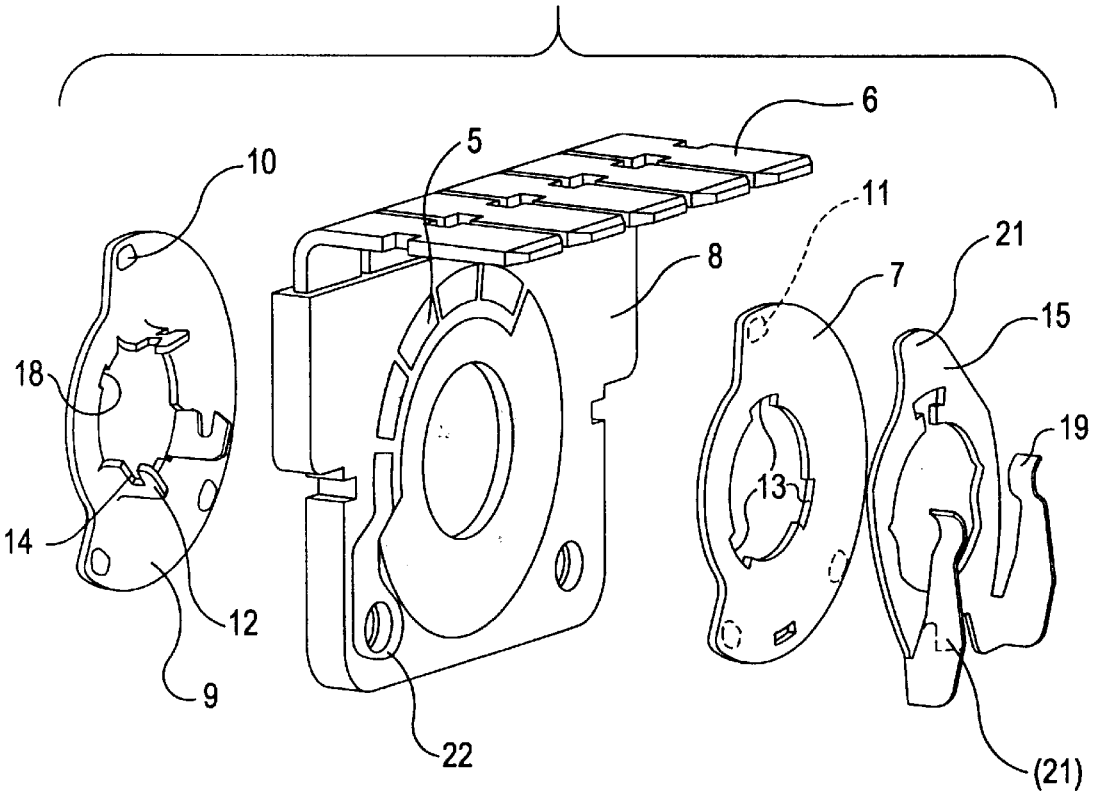
FIG. 3 is an exploded view of the switch insert shown in FIG. 2.

FIG. 3 shows an exploded view of the individual parts of the plastic plate 8, the first and second switch wipers 7, 9, and the leaf spring 15. The second switch wiper 9 has the positioning lugs 12 with the locking slots 14 for the leaf spring 15.

The first switch wiper 7 displays the positioning recesses 13 that cooperate with the positioning lugs 12 of the second switch wiper 9.

The leaf spring 15 displays pressing bends 21 that press on the surface of the first switch wiper 7 that faces away from the first wiper contacts 11 and load the first and second wiper contacts 11, 10 against the wiped contact segments 5. The snapping arms 19 are formed of bent lugs of the leaf spring 15.

It can be advantageous if one of the wiped contact segments 5 is structured as a neutral-position-signaling contact 22, so that a neutral position is made recognizable to an electronic controlling device or a safety circuit, for example.

Altogether, a switch insert 2 structured according to the invention provides a very flat structure. The doubled contact makes a higher current capacity possible.

The invention claimed is:

1. A switch insert for rotary-switch apparatus comprising: a contact plate, including a plastic plate with wiped contact segments arranged therein and plug terminal leads for current conduction and connection; a first switch wiper that can be moved by a rotary-switch manipulator, said first switch wiper having first-wiper contacts for contacting the wiped contact segments on a first side of said contact plate; and a second switch wiper arranged on a second side of the plate having second-wiper contacts; wherein the wiped contact segments are arranged in the plastic plate to be contacted by the second-wiper contacts of the second switch wiper on the second side of said contact plate, said second wiper contacts of said second switch wiper being arranged in a mirror-image pattern of the first wiper contacts of the first switch wiper;

wherein the second switch wiper has positioning lugs that extend through positioning recesses of the first switch wiper and that respectively define locking slots for accepting a leaf spring;

said switch insert further comprising said leaf spring mounted in said locking slots and pressing with a spring force against a surface of the first switch wiper facing away from the wiped contact segments, thereby loading the first and second wiper contacts of the first and second switch wipers against the wiped contact segments.

2. A rotary-switch apparatus including the switch insert as in claim 1, wherein the rotary switch apparatus further includes a bearing pin and the rotary switch manipulator, with the switch insert being arranged on the bearing pin and the bearing pin simultaneously supporting the rotary-switch manipulator for allowing the rotary-switch manipulator to rotate thereon, the rotary switch manipulator having a key lug extending into a control recess of at least one of the first and second switch wipers for causing the first and second switch wipers to rotate in response to rotation of the rotary-switch manipulator.

3. The rotary-switch apparatus as in claim 2, wherein the leaf spring includes two springable indexing snapping arms that cooperate with indexing snapping steps of the bearing pin to determine stopping positions of the first and second switch wipers.

4. The switch insert as in claim 1, wherein one of the wiped contact segments is structured to be suitable as a neutral-position-signaling contact.

* * * * *